United States Patent [19]

Yoshinaga et al.

[11] Patent Number: 4,558,571

[45] Date of Patent: Dec. 17, 1985

[54] WATER HEATING DEVICE OF HEAT PUMP TYPE

[75] Inventors: Shinya Yoshinaga; Hiroyuki Iwamura, both of Tochigi, Japan

[73] Assignee: Hitachi, Ltd., Tokyo, Japan

[21] Appl. No.: 532,562

[22] Filed: Sep. 15, 1983

[30] Foreign Application Priority Data

Sep. 22, 1982 [JP] Japan ..... 57-142671[U]

[51] Int. Cl.[4] ..... F25B 27/02

[52] U.S. Cl. ..... 62/238.6; 62/506; 237/2 B

[58] Field of Search ..... 62/238.6, 238.7, 183, 62/506, 263, 262, 324.4; 237/2 B

[56] References Cited

U.S. PATENT DOCUMENTS

| | | | |
|---|---|---|---|
| 2,042,812 | 6/1936 | Tull et al. | 62/238.6 X |
| 2,968,934 | 1/1961 | Komedera | 62/506 X |
| 3,513,663 | 5/1970 | Martin, Jr. et al. | 62/238.6 X |
| 4,091,994 | 5/1978 | Madsen | 62/238.6 X |
| 4,448,347 | 5/1984 | Dunstan | 237/2 B |

*Primary Examiner*—Lloyd L. King

*Attorney, Agent, or Firm*—Antonelli, Terry & Wands

[57] ABSTRACT

Provided is a water heating device of heat pump type which comprises a compressor, an evaporator, a duplex-pipe condenser and a blower means, characterized in that the blower means and the compressor are laid horizontally and, at the back of this arrangement, the evaporator is disposed, and the duplex-pipe condenser wound in a slender elliptic form is disposed on tops of the evaporator and blower means.

2 Claims, 5 Drawing Figures

WATER HEATING DEVICE OF HEAT PUMP TYPE

BACKGROUND OF THE INVENTION

1. Field of the Invention

The present invention relates to a water heating device of heat pump type.

2. Description of the Prior Art

In FIG. 1 and FIG. 2, a typical known heat pump type water heating device of heat pump is shown. The reference numeral 1 denotes a compressor having a duplex-pipe condenser 2 disposed therearound in a plurality of windings and an evaporator 3 is disposed in the upper portion of a rear face. The air is sucked into the device from a direction a and is allowed to flow out in a direction b, by a propeller fan 4 driven by a fan motor 5. Further, water is introduced into the duplex-pipe condenser from a portion 2*a* thereof for being heated, and then discharged from a portion 2*b* thereof. The reference numeral 6 denotes an outer case.

According to the above-mentioned construction, the depthwise dimension C of the device is determined depending upon the dimension of the circularly wound duplex-pipe condenser 2, so that the dimension C of the device is large. This results in a drawback that, when the device is installed by a wall, it forms a large protrusion from the wall, whereby the mountability deteriorates. Further, the above construction offers a large useless space between the propeller fan 4 and the evaporator 3, which results in another drawback that the device as a whole becomes bulky.

Object of the Invention

The object of the present invention is to provide a device which is small in dimension and also small in thickness.

SUMMARY OF THE INVENTION

The present invention provides a water heating device of heat pump type which comprises a compressor, an evaporator, a duplex-pipe condenser and a blower means, characterized in that the blower means and the compressor are laid horizontally and, at the back of this arrangement, the evaporator is disposed, and the duplex-pipe condenser wound in a slender elliptic form is disposed on the tops of the evaporator and blower means. Thus, it is possible to make the device small in dimension and yet small in thickness as well and, even when the device is installed by a wall, to provide a good installation because the dimension of its protrusion from the wall is small.

Further, a useless space which is inevitable in the prior art device is not created between the propeller fan and the evaporator, thereby enabling the device to be reduced in volume as well.

DETAILED DESCRIPTION OF THE PREFERRED EMBODIMENT

Figure 1:
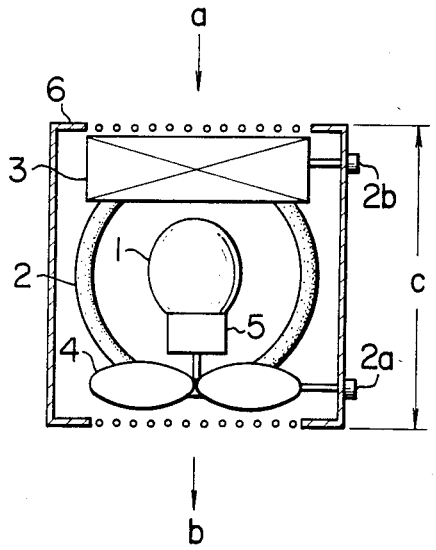
FIG. 1 (PRIOR ART)
FIG. 1 is a plan view of the interior of a typical known water heating device of heat pump type.
Figure 2:
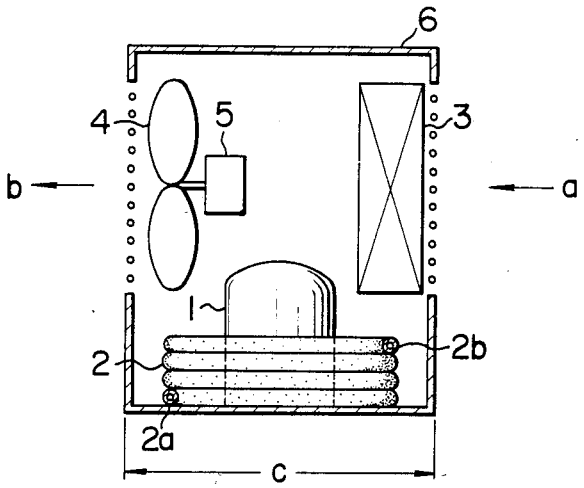
FIG. 2 (PRIOR ART)
FIG. 2 is a side view of FIG. 1 from the right side.
Figure 3:
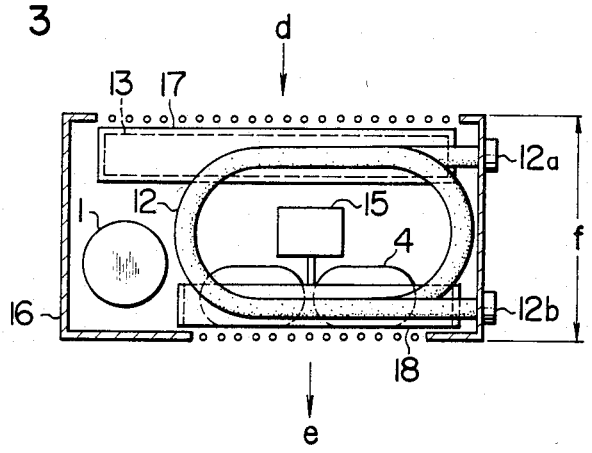
FIG. 3 is a plan view of the interior of a water heating device of heat pump type according to the present invention.
Figure 4:
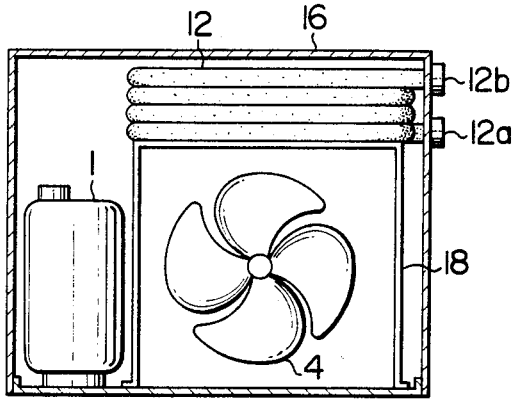
FIG. 4 is a front view of FIG. 3.
Figure 5:
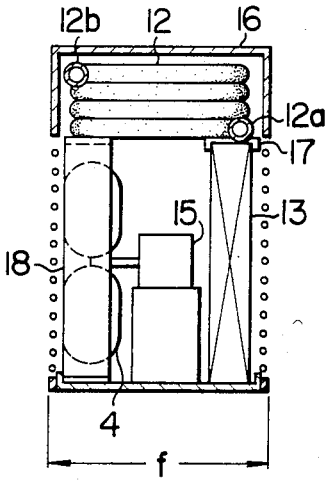
FIG. 5 is a side view of FIG. 3 as viewed from the right side.

Description will now be made of an embodiment of the invention with reference to FIGS. 3, 4 and 5. Same parts of portions as shown in FIG. 1 and FIG. 2 are denoted by like reference numerals. The reference numeral 12 denotes a duplex-pipe condenser wound in a plurality of windings in the form of a slender ellipse, which duplex-pipe condenser is fixed on an evaporator lid 17 fixed on the upper surface of the evaporator 13 as well as on a U-shaped reinforcing member 18 surrounding the propeller fan 4. The air is sucked into the device from a direction d and flows out in a direction indicated by an arrow e, by means of the propeller fan 4 driven by a fan motor 15. On the other hand, water is introduced into the duplex-pipe condenser 12 from a portion 12*a* thereof for being heated, and is discharged from a portion 12*b* thereof. The reference numeral 16 denotes an outer case.

According to the above-mentioned embodiment, the depthwise dimension f of the device is determined substantially in accordance with a total of the respective thickness dimensions of the evaporator 13, fan motor 15 and propeller fan 4, with thereby it is possible to make the depthwise dimension of the device small as compared with the prior art device. In addition, the useless space between the evaporator and the propeller fan, which was created there in the prior art device, is not produced. Thus, it is possible to make the device small in volume.

According to the present invention, it is possible to make the water heating device of heat pump type small in depthwise dimension and to thereby make the same small in thickness, thereby enabling a reduction of the device in volume as well. Thus, the invention has a merit in that it has a good installation.

What is claimed is:

1. A water heating device of heat pump type comprising a compressor, an evaporator, a duplex-pipe condenser and a blower means positioned within an outer case, characterized in that said blower means and said compressor are arranged horizontally with respect to one another and, at the back of this arrangement, said evaporator is disposed, and said duplex-pipe condenser is wound in a slender elliptic form and is disposed on top portions of said evaporator and blower means.

2. A water heating device of heat pump type according to claim 1, wherein a U-shaped reinforcing member is erected on a base of the device so as to surround a propeller fan of said blower means and an evaporator lid is fixed on an upper surface of said evaporator, whereby said duplex-pipe condenser is mounted upon said reinforcing member and said lid and is fixed thereon.

* * * * *